US005758678A

United States Patent [19]

Wu

[11] Patent Number: 5,758,678

[45] Date of Patent: Jun. 2, 1998

[54] STABILIZED UMBRELLA TOP STRUCTURE

[76] Inventor: Tsun-Zong Wu, P. O. Box 55-846, Taipei, Taiwan

[21] Appl. No.: 854,180

[22] Filed: May 9, 1997

[51] Int. Cl.[6] ..... A45B 15/00

[52] U.S. Cl. ..... 135/33.41; 135/33.6; 403/105; 24/108

[58] Field of Search ..... 135/33.6, 33.2, 135/33.4, 33.41, 37, 15.1; 403/105, 106, 329; 24/108, 598.1

[56] References Cited

U.S. PATENT DOCUMENTS

| | | | |
|---|---|---|---|
| 402,486 | 4/1889 | Schwartz | 135/33.6 X |
| 2,047,711 | 7/1936 | Siers | 135/33.2 X |
| 2,314,160 | 4/1943 | Weinberg | 135/33.41 |
| 4,422,467 | 12/1983 | Wu | 135/33.6 |
| 4,777,704 | 10/1988 | Acker | 24/108 X |
| 5,020,558 | 6/1991 | Huang | 135/33.4 X |
| 5,085,239 | 2/1992 | Chin-Hung et al. | 135/33.41 X |
| 5,429,147 | 7/1995 | Barrington | 135/33.41 X |
| 5,651,632 | 7/1997 | Gordon | 403/329 X |
| 5,653,197 | 8/1997 | Massaro et al. | 24/108 X |

FOREIGN PATENT DOCUMENTS

| | | | |
|---|---|---|---|
| 2248192 | 4/1973 | Germany | 135/33.6 |
| 0465155 | 12/1968 | Switzerland | 135/33.6 |

*Primary Examiner*—Lanna Mai

[57] ABSTRACT

An umbrella top structure includes an upper notch secured on a top portion of a central shaft, a top cap member engaged with the upper notch for fastening a central crimped portion of an umbrella cloth in between the top cap member and the upper notch as packed by a packing washer, with the top cap member having a plurality of ratchet teeth juxtapositionally formed on the cap member and the upper notch having an annular hook portion formed in an upper portion of the upper notch, whereby upon the engagement of the ratchet tooth of the cap member with the annular hook portion of the upper notch the cap member will not be loosened from the upper notch to thereby stabilize the fastening of the umbrella cloth on the top of the central shaft.

1 Claim, 2 Drawing Sheets

STABILIZED UMBRELLA TOP STRUCTURE

BACKGROUND OF THE INVENTION:

A conventional umbrella having an upper notch 2 secured on a central shaft 1 as shown in FIGS. 1 and 2 includes: a sleeve portion 21 secured on the top portion of the central shaft 1, a ferrule 24 disposed around the sleeve portion 21 for pivotally securing a plurality of top ribs of the umbrella rib assembly on the ferrule 24, a female-threaded hole 29 formed in the upper notch 2 to be engageable with a male-threaded shank portion 52 protruding downwardly from a cap member 51 of a top screw 5; and an umbrella cloth 3 having a central crimped portion 31 which is inversely folded from a central portion of the umbrella cloth 3 to be packed between the top screw 5 and the upper notch 2 by a packing washer 4.

However, there is an annular gap G formed between the upper notch 2 and the umbrella cloth 3 adjacent to the crimped portion 31 of the cloth 3, easily causing vibration and loosening of the top screw 5 as disengaged from the screw hole 29 formed in the upper notch 2 to thereby release the umbrella cloth 3 from the upper notch 2 to damage the umbrella.

The present inventor has found the drawbacks of the conventional upper notch and top structure of an umbrella and invented the present stable umbrella top structure.

SUMMARY OF THE INVENTION:

The object of the present invention is to provide an umbrella top structure including an upper notch secured on a top portion of a central shaft, a top cap member engaged with the upper notch for fastening a central crimped portion of an umbrella cloth in between the top cap member and the upper notch as packed by a packing washer, with the top cap member having a plurality of ratchet teeth juxtapositionally formed on the screw and the upper notch having an annular hook portion formed in an upper portion of the upper notch, whereby upon the engagement of the ratchet tooth of the top cap member with the annular hook portion of the upper notch, the cap member will not be loosened from the upper notch to thereby stabilize the fastening of the umbrella cloth on the top of the central shaft.

Figure 1:
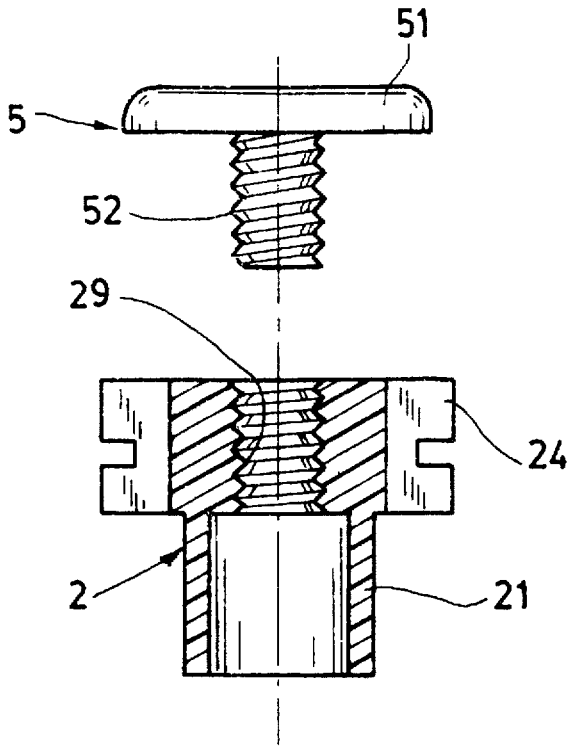
FIG. 1 PRIOR ART
FIG. 1 is an illustration showing a conventional upper notch and a to screw.
Figure 2:
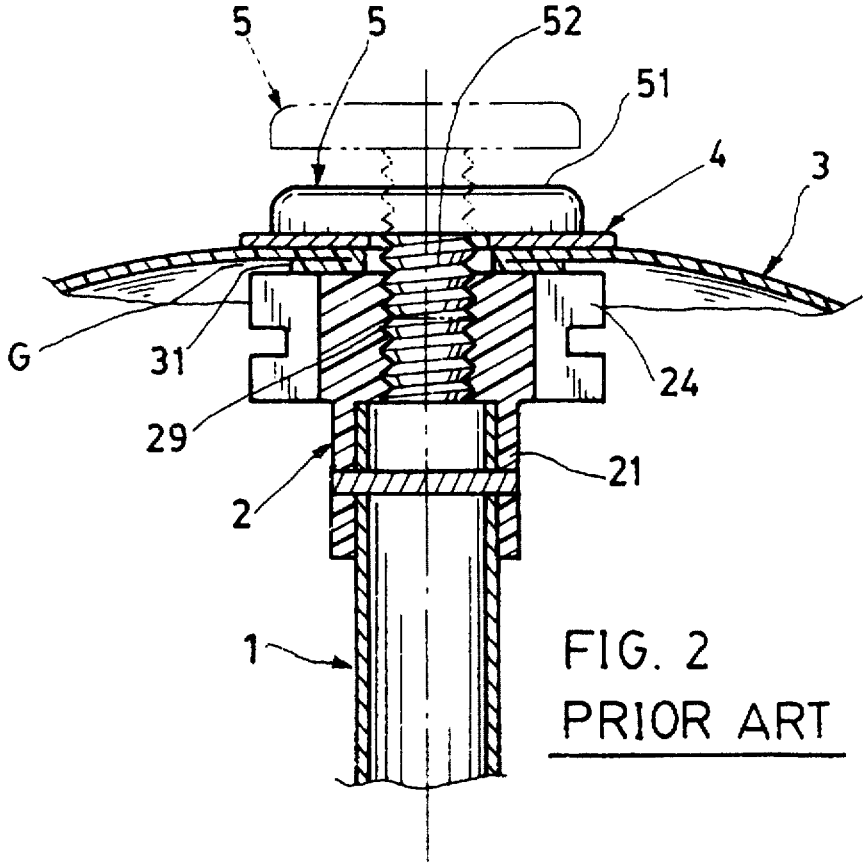
FIG. 2 PRIOR ART
FIG. 2 is a sectional drawing of the conventional umbrella when engaging top screw with the upper notch of FIG. 1.
Figure 3:
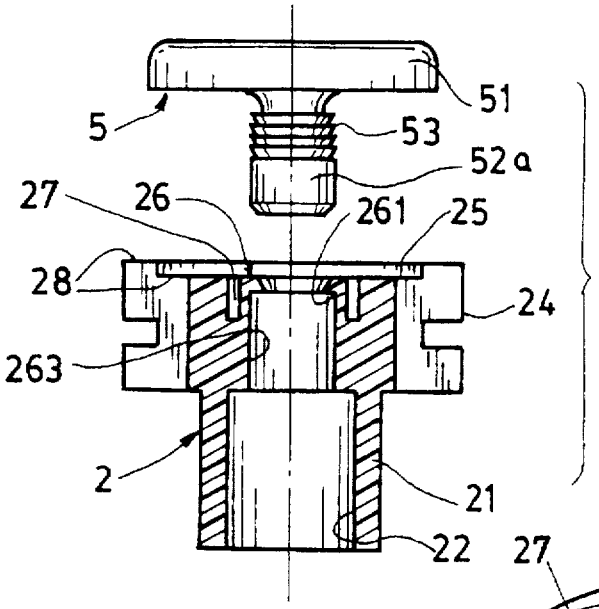
FIG. 3 shows an upper notch and a top cap member of the present invent
Figure 4:
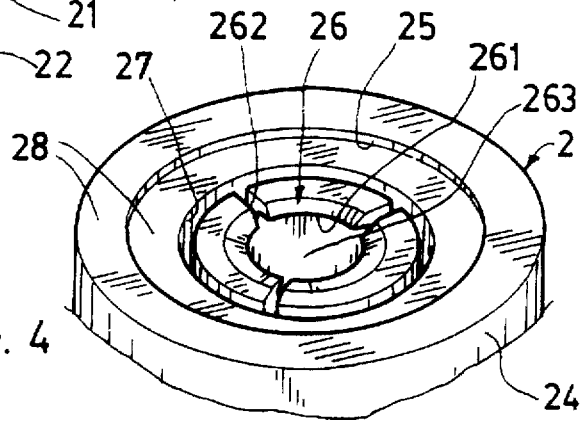
FIG. 4 a partial perspective view of the upper notch.
Figure 5:
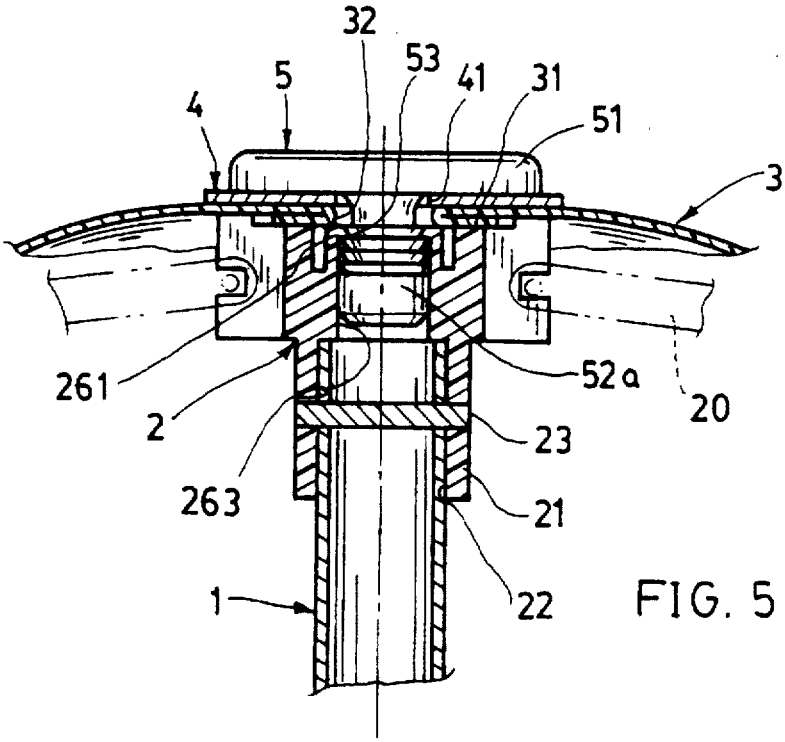
FIG. 5 is a sectional drawing of the present invention when engaging the upper notch with the top cap member for fastening the umbrella cloth therebetween.

DETAILED DESCRIPTION:

As shown in FIGS. 3–5, an umbrella top structure of the present invention comprises: an upper notch 2 secured on a top portion of a central shaft 1, an umbrella cloth 3 having a central crimped portion 31 as inversely folded from a central portion of the umbrella cloth 3 to form a central cloth hole 32, and a top cap member 5 engaged with the upper notch 2 for fastening and clamping the central crimped portion 31 of the umbrella cloth 3 in between the top cap member 5 and the upper notch 2 as packed by a packing washer 4 which may be made of cloth, fabric, plastic or metal materials (not limited) and is formed with a central washer hole 41 through the washer 4.

The upper notch 2 and the top cap member 5 may be made of plastic or metal materials, also not limited in the present invention. The notch 2 is preferably made of plastic material by any conventional plastic molding processes.

The upper notch 2 includes: a sleeve portion 21 having a tube hole 22 formed in a central bottom portion of the sleeve portion 21 to be engaged with a top end portion of the central shaft and fixed on the central shaft 1 by a pin 23; a ferrule 24 circumferentially disposed around the sleeve portion 21 for pivotally securing a plurality of top ribs 20 of an umbrella rib assembly for securing the umbrella cloth 3 on the rib assembly; and a chuck portion 26 formed in an upper central portion of the ferrule 24 for engaging the top cap member 5 for fastening and clamping the central crimped portion 31 of the umbrella cloth 3 in between the top cap member 5 and the upper notch 2 as packed by the packing washer 4.

The packing washer 4 is formed with a central hole 41 therethrough for passing the cap member 5 when engaged with the notch 2. The umbrella cloth 3 is also formed with a central hole 32 for passing the cap member 5 when engaged with the notch 2.

The top cap member 5 includes: a cap portion 51, a shank portion **52*a* protruding downwardly from the cap portion 51 and having a plurality of ratchet teeth 53 juxtapositionally formed on the shank portion 52*a***.

The chuck portion 26 as positioned in an upper recess 25 as recessed in an upper central portion of the ferrule 24 of the upper notch 2 includes: an annular hook portion 261 concentrically formed in an upper central portion of the chuck portion 26 for engaging each ratchet tooth 53 formed on the shank portion **52*a* of the top cap member 5, a plurality of slits 262 radially formed in the annular hook portion 261, and a central hole 263 formed in a central portion in an upper portion of the upper notch 2 for engaging the shank portion 52*a* of the top cap member 5 in the central hole 263**.

The chuck portion 26 is formed in a central bottom portion of the upper recess 25 of the upper notch 2 and is separated from a top periphery 28 circumferentially disposed around the ferrule 24 by an annular groove 27 concentrically recessed in a bottom of the upper recess 25 recessed in the upper portion of the upper notch 2.

The upper recess 25 has a depth generally equal to a thickness of the central crimped portion 31 of the umbrella cloth 3 for overlaying the crimped portion 31 of the umbrella cloth into said upper recess 25 as packed between the top cap member 5, the washer 4 and the upper notch 2.

When assembling the umbrella top of the present invention, the shank portion **52*a* of the top cap member 5 is inserted into the central hole 263 in the chuck portion 26 to engage the ratchet tooth 53 on the top cap member 5 with the annular hook portion 261 of the upper notch 2 by sandwiching or clamping the crimped portion 31 of the umbrella cloth 3 in between the cap portion 51 of the top cap member 5 and the bottom of the upper recess 25 of the upper notch 2 as packed by the packing washer 4**.

Since the ratchet tooth 53 on the top cap member 5 is deadly locked by the annular hook portion 261 in the chuck portion 26 of the upper notch 2 when depressing the top cap member 5 downwardly, the cap member 5 will not be removable from the upper notch 2 to thereby stabilize the fixation of the umbrella cloth on the top of the central shaft 1 without loosening.

The radial slits 262 formed in the chuck portion 26 and the annular groove 27 disposed around the chuck portion 26 will serve as a buffer to allow the expansion of the hook portion 261 when downwardly depressing the shank portion 52*a* of the top cap member 5 into the central hole 263 in the notch 2, thereby enhancing a smooth engagement of the top cap member 5 with the upper notch 2. However, the slits 262 may also be eliminated in this invention.

The upper recess 25 as recessed in an upper central portion of the upper notch 2 will provide a space for overlaying the central crimped portion 31 of the umbrella cloth 3 in the upper recess 25 to thereby eliminate any "gap" between the cap member 5 and the upper notch 2 to stabilize the fixation of the cap member 5 and the umbrella cloth 3 on the upper notch 2.

Accordingly, the present invention is superior to the conventional umbrella top structure with improved irremovability of the top cap member and the umbrella cloth from the top of the shaft 1, thereby prolonging the service life of the umbrella.

The present invention may be modified with departing from the spirit and scope of this invention. The number of ratchet teeth of the cap member 5 of the present invention are not limited, but the ratchet teeth 53 may be adjustably engageable with the hook portion 261 in the upper notch 2, depending upon the thickness of the umbrella cloth 3 including the central crimped portion 31 and the thickness of the washer. Anyway, once upon depression of the top cap member into the central hole in the upper notch, the cap member 5 will not be removable from the notch 2 to thereby stabilize the fixation of the umbrella cloth 3 and the cap member 5 on the top of the notch 2.

I claim:

1. An umbrella top structure comprising:

an upper notch secured on a top portion of a central shaft and pivotally securing a plurality of top ribs of an umbrella rib assembly to said upper notch;

a top cap member engaged with said upper notch fastening and clamping a central crimped portion of an umbrella cloth secured on said umbrella rib assembly, a packing washer being inserted between the umbrella cloth and the top cap member;

said upper notch including: a sleeve portion secured on a top end portion of the central shaft, a ferrule circumferentially disposed around the sleeve portion and pivotally securing said plurality of top ribs of the umbrella rib assembly for securing the umbrella cloth on the rib assembly; and a chuck portion formed in an upper recess in an upper central portion of the ferrule and engaging the top cap by member fastening and clamping the central crimped portion of the umbrella cloth in between the top cap member and the upper notch;

said top cap member including: a cap portion, a shank portion protruding downwardly from the cap portion and having at least a ratchet tooth formed on the shank portion;

said chuck portion having an annular hook portion concentrically formed in an upper central portion of the chuck portion and engaging said ratchet tooth formed on the shank portion of the top cap member and deadly locking said top cap member with said upper notch for stably fastening said umbrella cloth in between said top cap member and said upper notch, said chuck portion further includes a central hole formed in an upper central portion of the upper notch; said central hole engages the shank portion of the top cap member; and;

said chuck portion further formed in a central bottom portion of the upper recess of the upper notch and separated from a top periphery circumferentially disposed around the ferrule by an annular groove concentrically recessed in a bottom of the upper recess recessed in the upper portion of said upper notch;

the improvement which comprises:

said annular hook portion of said chuck portion radially formed with a plurality of slits in said annular hook portion.

* * * * *